United States Patent [19]

Civolani

[11] 4,395,838

[45] Aug. 2, 1983

[54] EJECTOR FOR A GUN USING CASELESS AMMUNITION HAVING A PERIMETRIC PRIMER

[75] Inventor: Bruno Civolani, Via F. Bolognese 2, Bologna, Italy, 40129

[73] Assignees: Bruno Civolani, Bologna; Paolo Benelli, Pesaro, both of Italy

[21] Appl. No.: 232,530

[22] Filed: Feb. 9, 1981

[30] Foreign Application Priority Data

Jul. 8, 1980 [IT] Italy ..... 44014 A/80

[51] Int. Cl.[3] ..... F41C 15/00; F41C 15/12

[52] U.S. Cl. ..... 42/25

[58] Field of Search ..... 42/25

[56] References Cited

U.S. PATENT DOCUMENTS

| | | | |
|---|---|---|---|
| Re. 1,952 | 5/1865 | Hicks | 42/25 |
| 3,618,246 | 11/1971 | Woodring | 42/25 X |
| 3,641,692 | 2/1972 | Wells | 42/25 |
| 4,123,963 | 11/1978 | Junker | 42/25 X |
| 4,282,670 | 8/1981 | Junker | 42/25 X |

FOREIGN PATENT DOCUMENTS

| | | | |
|---|---|---|---|
| 945246 | 12/1963 | United Kingdom | 42/25 |

*Primary Examiner*—Charles T. Jordan
*Assistant Examiner*—Ted L. Parr
*Attorney, Agent, or Firm*—Amster, Rothstein & Engelberg

[57] ABSTRACT

An ejector for firearms which use projectiles without cases of the new design with a perimetric primer. Such an ejector may be used on any type of gun which is equipped with a radial percussion system designed to percuss such projectiles.

Used with the projectiles without cases, the ejector should eject from the detonating chamber of the gun only those projectiles on which the firing pin has not provoked the detonation of the charge at the moment of percussion.

At the same time since it is impossible to prevent from time to time during firing the occurrence of defective projectiles which remain in the barrel, during the phase of introduction into the detonating chamber the ejector should be able to hook onto every single projectile, retaining hooked onto it only those which, due to defects, remain in the detonating chamber and leaving all the others free to come out of the mouth of the barrel.

2 Claims, 8 Drawing Figures

EJECTOR FOR A GUN USING CASELESS AMMUNITION HAVING A PERIMETRIC PRIMER

BACKGROUND OF THE INVENTION

1. Field of the Invention

The present invention relates to ejectors for fire-arms using auto-propulsion projectiles without cartridge cases and with a perimetric primer.

2. Description of the Prior Art

Such projectiles, which are based on a completely new concept from conventional projectiles, are described in Italian Pat. No. 932.381 and No. 972.058, to which reference should be made for a better understanding of the present invention.

The ejectors for fire-arms in use at the present time are normally constituted by appropriately shaped levers which are fixed to the lock of the gun in a suitable position for hooking onto an appropriate seat provided on the said cartridge case, during the phase when the cartridges are introduced into the barrel.

The hooking of the cartridge onto the ejector is always assured by the elastic effort exerted on the ejector by a helical spring or by the special elastic construction of the front part of the ejector which bears the hooking claw.

The functioning of all these types of ejector is ensured due to the fact that at the moment of firing, the single bullet coming out of the mouth of the barrel leaves its case behind in the detonating chamber until the recoil action of the gun when the lock is opened and ejection of the said case is brought about.

The main aim of this type of ejector is therefore to keep the case of the bullet introduced into the detonating chamber hooked onto the lock as well as possible in order to allow reliable ejection, thus ensuring the continuous repetition of the firing action.

It is obvious that, in such cases, the inconvenience arising from unsuccessful percussion or a defective bullet which results in the charge not being exploded successfully during the firing action and leaves the gun with the cartridge in its barrel, can be eliminated immediately by means of opening the lock of the gun manually which, due to the ejector, would bring about ejection of the cartridge left in the detonating chamber, so that the gun is returned to a perfect state of efficiency.

The functioning of an ejector in the case of projectiles without a cartridge case is completely different from that described above relative to ejectors for conventional projectiles.

In fact, in the case of projectiles without cases, the ejector should extract from the detonating chamber of the gun only those projectiles for which the firing pin has not provoked the explosion of the charge at the moment of striking.

At the same time, since it is not possible to prevent, now and then during firing, the occurence of defective projectiles which remain in the barrel, during the phase of introducing the projectiles into the detonating chamber the ejector should hook itself onto every single projectile, retaining only those which due to defects, remain in the detonating chamber and leaving all the others free to come out of the mouth of the gun.

SUMMARY OF THE INVENTION

More particularly, the ejector according to the invention for fire-arms which use careless ammunition having a perimetric primer is characterised by the fact that it is an integral part of a closure pin incorporated in the lock of the gun and projecting from the front plane of the lock facing the rear face of the breech, and is constituted by a projection on the closing pin, bearing a hooking claw designed to penetrate into an internal cavity provided in the rim of the rear closure of the projectile at the moment when the projectile is being introduced into the detonating chamber, rendering it integral with the closing pin.

The functioning of this type of ejector is made possible by the support which firstly the magazine and then the walls of the detonating chamber of the gun gives to all the front part of the said projectile during the phase when it is being introduced into the barrel.

At that point, if the projectile introduced into the barrel is percussed properly, the gas pressure developing from the explosion of the charge, while initiating the propulsion of the projectile out of the detonating chamber towards the mouth of the barrel, opens the rear rim on the said projectile, thereby freeing it, without any hinderance, from the hooking claw on the ejector provided on the closing pin.

Immediately after the projectile leaves the barrel, the said pressure opens the lock of the gun, allowing recocking to follow, thereby ensuring continuing of the firing action.

If, on the other hand, due to weak percussion or a defective projectile, the charge of the projectile, is not detonated during the firing action, the projectile remains attached to the hooking claw of the ejector provided on the closing pin which has previously introduced it into the detonating chamber.

Similarly to what happens on the guns now in use, it is sufficient to open the lock of the gun manually to obtain ejection of the projectile which has not detonated and which has remained in the barrel.

The subsequent expulsion of the projectile from the gun occurs under the effect of its weight, when the lock reaches a position at the end of its opening path, via an expulsion hole provided on the structure of the gun, in a rear position relative to the magazine.

In this position, in fact, since the front part of the projectile is no longer supported either by the walls of the detonating chamber or by the magazine, there is no longer the necessary support to maintain the said projectile positioned axially with the closing pin; as a consequence the projectile frees itself from the hooking claw of the ejector provided on the closing pin and falls to the ground.

BRIEF DESCRIPTION OF THE DRAWING

The invention will be better understood from the following detailed description, given purely by way of example and in no way limiting, of one embodiment form thereof, with reference to the attached drawings.

DETAILED DESCRIPTION OF THE PREFERRED EMBODIMENT

It will be seen that in the above-mentioned Figures ejection equipment according to the invention is shown on a gun with a closure with a recoiling mass, wherein all those parts which function in a similar way to the guns at present in use have been left out. A radial percussion system which is suitable for percussing the projectile without a case to which the present invention relates is described in Italian Pat. No. 1 029 293.

Figure 1:
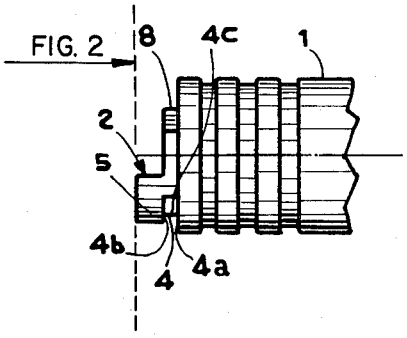
FIG. 1 is an enlarged side view of the profile of the ejector provided on the front part of the closing pin.
Figure 2:
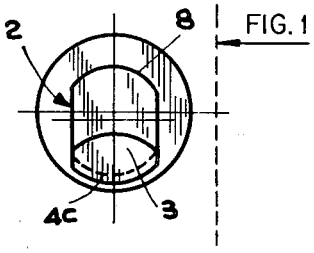
FIG. 2 is an enlarged front view of the profile of the ejector shown in FIG. 1.
Figure 3:
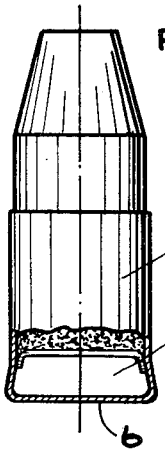
FIG. 3 is an enlarged partial section showing the shape of the rim on the rear closure of the projectiles without cases to which the invention refers.

Considering first Figures 1 to 3, it will be seen that the ejector (see FIG. 1) is provided on the front part of a closure pin (1) and is constituted principally of a projection (2) which terminates at the lower part in a bulge (3) (see FIG. 2), with a substantially lens-shaped section.

The groove (4) formed by the walls 4*a*, 4*b*, 4*c* which forms the hooking claw (5) is provided on the projection (2) on the closing pin (1); this claw is designed to engage on the closure rim (6) of the projectile (7) (see FIG. 3).

The curved wall 4*c* of the groove (4) extends on the closure pin (1) in a position diametrically opposite the curved surface on the support (8), exactly opposite the hooking claw (5), which ensures the coaxial position of the rear rim (6) of the projectile (7) and the closure pin (1).

Figure 4:
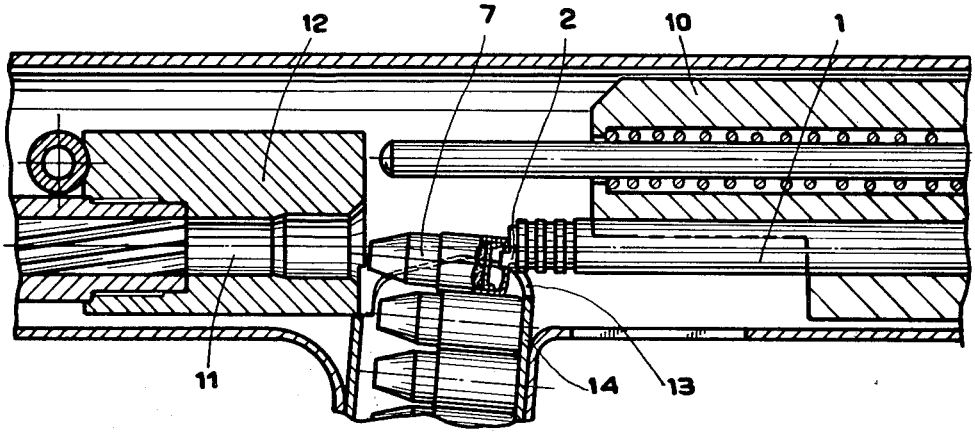
FIG. 4 is a section showing the ejector which, in the first phase of closing, penetrates into the rear part of the projectile located on the magazine, initiating its introduction into the detonating chamber.
Figure 5:
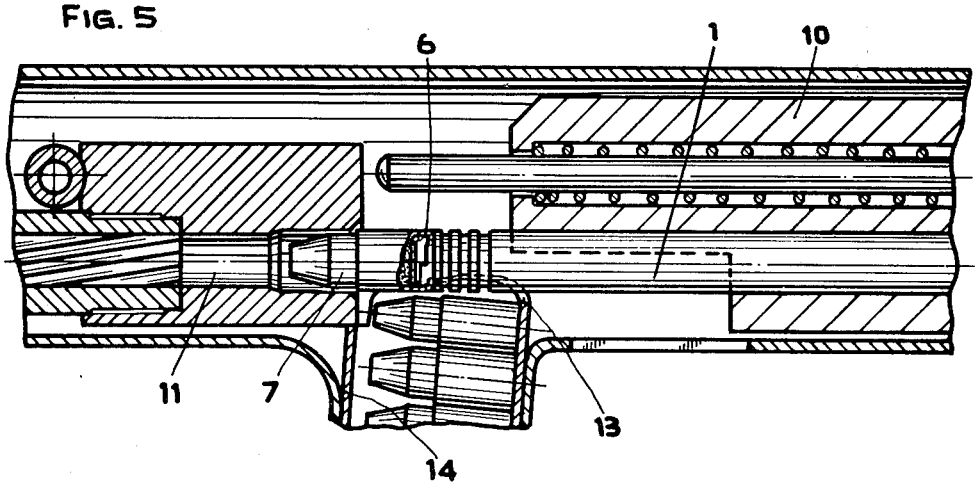
FIG. 5 is a section showing the ejector which, during the closing phase, has already pushed the projectile forwards out of the guide of the magazine to line up with the barrel—closing pin axis.

The described ejector functions in the following way:

In the first phase of the introduction into the barrel (see FIG. 4) the projection (2) on the closing pin (1) incorporated in the lock (10) penetrates into the cavity (9) inside the rear rim (6) (see FIG. 3) of the projectile (7) and initiates a thrust towards the detonating chamber (11) provided on the breech (12), passing through the guideway (13) in the magazine (14). Continuing the phase of the introduction into the barrel (see FIG. 5) the projectile (7) slides completely through the guideway (13) of the magazine (14), moving into a position which is axial with the closing pin (1), since it is supported on the front part by the walls of the detonating chamber (11) and is guide on its rear rim (6) by the curved surface (4*c*) of the groove (4) (see FIG. 1) and on the curved surface of the support (8), both of which are provided on the closing pin (1).

In this phase the hooking claw (5) (see FIG. 1) engages with the interior of the closing rim (6) of the projectile (7), rendering it integral with the closing pin (1) incorporated in the lock (10).

In this way (see FIG. 6) the phase of closing the gun with the lock (10) shut down onto the breech (12) and the projectile (7) hooked on the hooking claw (5) provided on the closing pin (1) is completed.

In this phase, if the percussion of the projectile (7) takes place properly, the pressure of the gas developing from the detonation of the charge, in the course of initiating the propulsion of the projectile (7) towards the mouth of the barrel, opens its rear closure rim (6) (see FIG. 3), freeing it without hinderance from the hooking claw (5) provided on the closing pin (1).

Immediately after the projectile leaves the barrel, the said pressure opens the lock of the gun, allowing the subsequent recocking and thereby ensuring the continuity of the firing action.

Figure 6:
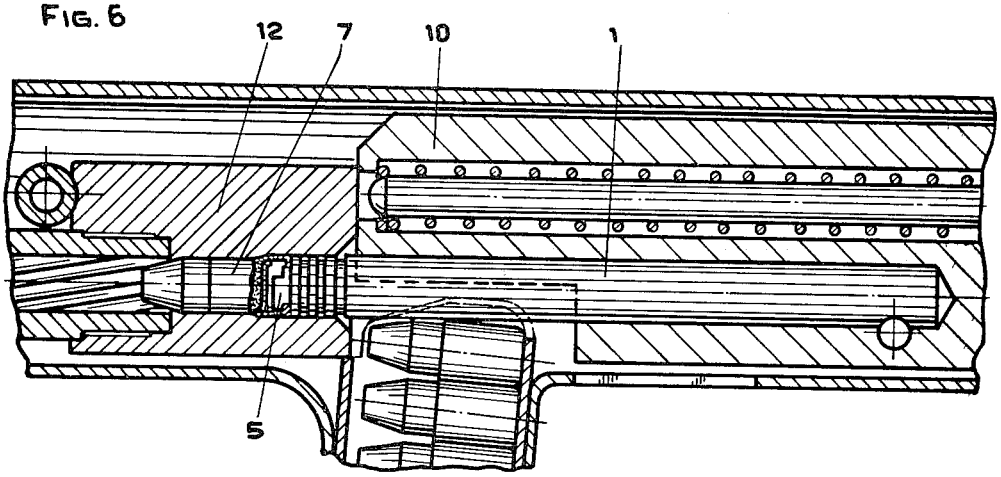
FIG. 6 is a section showing the ejector with the projectile hooked on and the lock in the closed position.

If, on the other hand, due to a weak percussion or a defective projectile, the charge of the projectile (7) is not detonated, the latter remains attached to the hooking claw (5), in the position shown in FIG. 6, thus interrupting the firing action.

Figure 7:
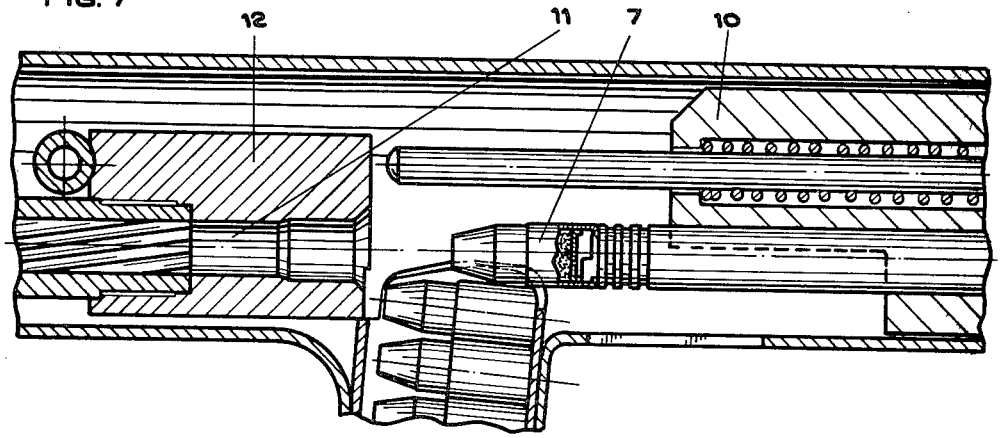
FIG. 7 is a section showing the ejector with the projectile hooked onto it during the phase of ejecting it from the detonating chamber after the action of opening the lock by hand.

By opening the lock (10) manually (see FIG. 7), the ejection of the projectile (7) from the detonating chamber (11) of the breech (12) is brought about.

This effect is ensured by the support which is provided firstly by the walls of the detonating chamber (11) and then by the projectiles in the magazine and the said magazine, having dealt with the last shot, to the front part of the projectile (7), holding it absolutely axial with the closing pin (1).

Figure 8:
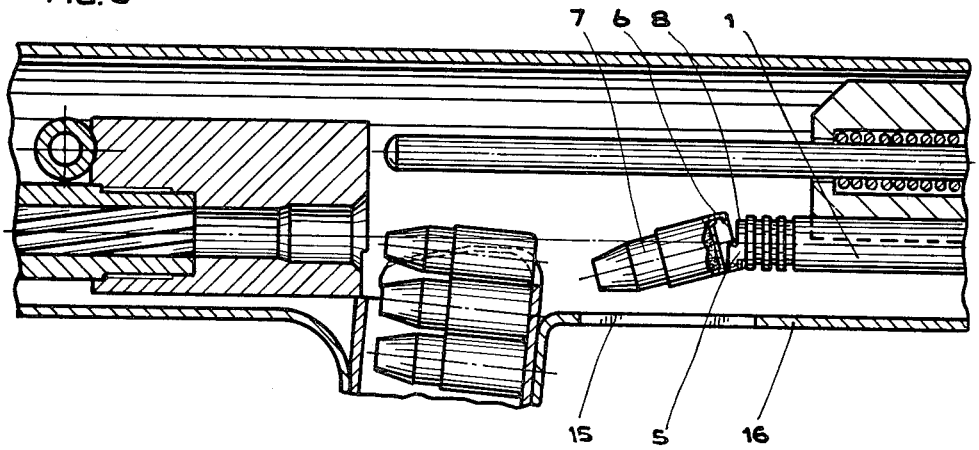
FIG. 8 is a section showing the ejector in the phase when the lock has been completely opened by hand, with the projectile, which is no longer supported at its front part on the magazine, falling to the ground.

When the lock has been completely opened by hand (see FIG. 8), due to the effect of its weight the projectile (7) which is no longer supported at its front part, no longer maintains its coaxial position with the axis of the closing pin (1), and it disengages its rear closure rim (6) firstly from the supporting surface (8) and then subsequently from the hooking claw (5), both of which are provided on the closing pin (1).

The expulsion of the projectile (7) from the gun occurs via the expulsion hole (15) provided on the lower part of the structure (16) of the gun, thus allowing it to fall to the gound.

The subsequent closing of the lock (10) finds the hooking claw (5) ready to hook onto a new projectile, thus ensuring the recommencement of the firing action.

The entire system therefore accomplishes the aim of ejecting the projectiles from the detonating chamber of the gun, ensuring correct functioning and the rapid expulsion of projectiles which, for very varied reasons, may possibly remain in the barrel.

Although only a single embodiment of the invention has been described, naturally it is possible to effect numerous variations and modifications without exceeding the scope of the said invention.

What I claim is:

1. An ejector for a gun using caseless ammunition having a perimetric primer and a cavity at one end thereof, the cavity being partially defined by the exterior of the ammunition and a rim extending radially-inwardly from the exterior of the ammunition, and defining an aperture, the gun including an expulsion hole for the disposal of unfired ammunition, a breech having a detonation chamber for the firing of the ammunition, a lock facing the breech, and a generally cylindrical closure pin fixedly mounted to the lock, the closure pin and lock being slidable with respect to the breech from a front position adjacent the breech to a rear position removed from the breech, the ejector comprising:

a projection disposed on the front of the closure pin terminating at its lower end in a substantially lens-shaped section, said projection terminating at its upper end in a curved surface; and a groove formed between the forward end of said closure pin and the rear surface of said projection to provide a hooking claw, said groove including a curved wall positioned diametrically opposite to the curved surface, at the upper end of said projection, said hooking claw being adapted to enter the cavity through the aperture prior to entry of the ammunition into the detonation chamber, with the curved wall and curved surface cooperating with said rim to ensure coaxial positioning of the ammunition on the closure pin when the ammunition is in the gun and to facilitate expulsion of unfired ammunition through said expulsion hole.

2. A gun for use with caseless ammunition having a perimetric primer and a cavity at one end thereof, the cavity being partially defined by the exterior of the ammunition and a rim extending radially-inwardly from the exterior of the ammunition, the rim defining an aperture, wherein the gun comprises:

a breech having a detonation chamber for the firing of ammunition;

a lock slidable with respect to the breech from a front position adjacent the breech to a rear position removed from the breech;

an expulsion hole for the disposal of unfired ammunition, disposed below and behind said breech;

a generally cylindrical closure pin fixedly mounted to the lock, and positioned on said lock so that said closure pin partially enters said detonation chamber when said lock is in said front position; and an ejector for engaging said ammunition and conveying said ammunition to said breech for firing and for releasing unfired ammunition through said expulsion hole, said ejector including:

a projection disposed on the front of the closure pin terminating at its lower end in a substantially lens-shaped section, said projecting terminating at its upper end in a curved surface; and a groove formed between the forward end of said closure pin and the rear surface of said projection to provide a hooking claw, said groove including a curved wall positioned diametrically opposite to the curved surface, at the upper end of said projection said hooking claw being adapted to enter the cavity through the aperture prior to entry of the ammunition into the detonation chamber with the curved wall and curved surface cooperating with said rim to ensure coaxial positioning of the ammunition on the closure pin when the ammunition is in the gun and for facilitating expulsion of the unfired ammunition through said expulsive hole.

* * * * *